US007310490B2

(12) United States Patent
Lee

(10) Patent No.: US 7,310,490 B2
(45) Date of Patent: Dec. 18, 2007

(54) DEVELOPING UNIT FOR AN IMAGE FORMING APPARATUS

(75) Inventor: Min-soo Lee, Euiwang-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 325 days.

(21) Appl. No.: 11/183,774

(22) Filed: Jul. 19, 2005

(65) Prior Publication Data

US 2006/0013622 A1 Jan. 19, 2006

(30) Foreign Application Priority Data

Jul. 19, 2004 (KR) ..... 10-2004-0056016

(51) Int. Cl.
*G03G 15/09* (2006.01)

(52) U.S. Cl. ..... 399/274; 399/275

(58) Field of Classification Search ..... 399/107, 399/119, 254, 265, 267, 274, 275
See application file for complete search history.

(56) References Cited

U.S. PATENT DOCUMENTS 6,757,509 B2 * 6/2004 Shoji et al. ..... 399/267
6,901,233 B2 * 5/2005 Aoki et al. ..... 399/270
7,139,517 B2 * 11/2006 Enoki et al. ..... 399/267
7,171,145 B2 * 1/2007 Takeuchi et al. ..... 399/274
7,208,254 B2 * 4/2007 Yuasa et al. ..... 430/108.2

FOREIGN PATENT DOCUMENTS

| | | |
|---|---|---|
| JP | 08-286518 | 11/1996 |
| JP | 10-048958 | 2/1998 |
| JP | 2002-116626 | 4/2002 |

* cited by examiner

*Primary Examiner*—Hoan Tran
(74) *Attorney, Agent, or Firm*—Roylance, Abrams, Berdo & Goodman, LLP

(57) ABSTRACT

A developing unit for an image forming apparatus using a two-property developer that induces a magnetic attraction force based on the slope of a curved line representing the magnetism of each magnetic pole of a magnetic field generating part of a developing roller and determining a developer-regulating position where the changes of the magnetic attraction force are minor based on the magnetic attraction force in order to assure stable transfer of the developer to a photoconductive medium.

12 Claims, 4 Drawing Sheets

WAVEFORM DIAGRAM OF MAGNETIC FLUX DENSITY

α° : DISPLACED ANGLE OF MAGNET ROLLER

Br : MAGNETISM IN NORMAL DIRECTION OF MAGNET ROLLER

Bθ : MAGNETISM IN CIRCUMFERENTIAL DIRECTION OF MAGNET ROLLER

B : MAGNETISM OF MAGNET ROLLER AT PREDETERMINED ANGLE α°

DEVELOPING UNIT FOR AN IMAGE FORMING APPARATUS

CROSS-REFERENCE TO RELATED APPLICATION

This application claims the benefit under 35 U.S.C. §119 (a) of Korean Patent Application No. 2004-56016, filed Jul. 19, 2004, in the Korean Intellectual Property Office, the entire disclosure of which is hereby incorporated by reference.

BACKGROUND OF THE INVENTION

1. Field of the Invention

The present invention relates to an image forming apparatus such as an electrophotographic printer or a photocopier. More particularly, the present invention relates to a developing unit for visualizing an electrostatic latent image formed on a photoconductive medium by a developer, and especially, to a method for providing stable regulation of an amount of developer transferred to the photoconductive medium and a developing unit for implementing the method.

2. Description of the Related Art

Generally, electrophotographic image forming apparatuses such as printers and photocopiers form an electrostatic latent image by electrifying a photosensitive means such as a photoconductive drum or a photoconductive belt and develop the carried image into a visible image by the developer and transfer the electrostatic latent image to a printing medium, such as paper, to develop the visible image. Accordingly, a desired image is output.

Types of developing systems used in electrophotographic image forming apparatuses include one-property developing systems, which use only a powder toner for printing and two-property developing systems, which use a developer comprising a carrier having a ferrite component and toner particles.

Such a two-property developing system is getting widely adopted in the high-speed printer field due to its fast printing, the long lifespan of the consumable parts and its low maintenance cost.

As shown in FIG. 1, a conventional electrophotographic image forming apparatus generally includes a developing unit for supplying a developer to an electrostatic latent image formed on a photoconductive medium, thereby converting the electrostatic latent image into a visible image.

FIG. 1 schematically shows a developing unit for an electrophotographic image forming apparatus using the conventional two-property developer.

Referring to FIG. 1, the conventional developing unit comprises a developer receptacle 11 storing a developer 1, a developing sleeve 14*a*, a magnet roller 14*b*, a developer-supply roller 12 and 13, and a regulating blade 15.

The developing sleeve 14*a* is rotatably mounted in the developer receptacle 11. The magnet roller 14*a* is fixed in the developing sleeve 14*a*. The developer-supply rollers 12 and 13 such as agitating screws transfers the developer 1 onto a surface of the developing sleeve 14*a*. The regulating blade 15 restricts the thickness of the developer supplied to the surface of the developing sleeve 14*a* to a thin layer. A photoconductive drum 16 serves as an image carrier. A developing roller 14 comprises the developing sleeve 14*a* and the magnet roller 14*b* that are engaged with each other.

In the conventional developing unit as the above, the developer 1, supplied to an N-pole by rotation of the developing sleeve 14*a*, is restricted by the regulating blade 15 to a thin layer on the developing sleeve 14*a* while being transferred from an S2-pole to an N1-pole. When the thin layer of developer is transferred to an S1-pole, which is a main pole of developing, the developer is drawn by the magnetism to develop the electrostatic latent image formed on the photoconductive drum 16. The developer on the developing sleeve 14*a* is then recovered into the developing receptacle 11 by repulsive magnetic fields of N2 and N3 poles.

According to the conventional developing unit using the two-property developer, when magnetism in a normal direction is much stronger than magnetism in a tangential direction, the amount of developer transfer is highly influenced by the magnetic state of the surface of the developing sleeve 14*a*. This is because the capability of the developing sleeve 14*a* to transfer the developer heavily depends on the surface configuration of the developing sleeve 14*a* or an abrasion state of the developer surface.

Also, as the amount of the developer held by the developing sleeve 14*a* increases, the developer deteriorates due to excessive friction thereof.

The transferring capability of the developing sleeve 14*a* may be improved by the tangential magnetism if the tangential magnetism is stronger than the normal magnetism. Accordingly, variation in the amount of developer, which is due to the surface configuration of the developing sleeve 14*a* and the abrasion state of the developer surface, can be restrained.

However, because the amount of developer at the developing sleeve 14*a* decreases, it can not generate enough frictional electrification of the developer. Therefore, a background image may appear, or the developing characteristic of a solid image may deteriorate.

Therefore, the developing unit for the image forming apparatus using the two-property developer is required to restrain deterioration of the toner and carrier as much as possible in order to obtain a high-quality image for a long time and to stabilize the amount of developer transferred to the photoconductive medium.

As a suggestion for satisfying the above requirements, Japanese Patent Laid-open No. 2003-15422 discloses a method for stabilizing the amount of the developer transferred by locating a developer-regulating position where a difference between the vertical magnetic flux density and the horizontal magnetic flux density is within a range of approximately 5 mT, as shown in FIG. 2.

However, the force which transfers the developer is based on the magnetic attraction force which draws the developer to the developing sleeve 14*a*. Therefore, a moving range of the developer is hard to precisely regulate using only the vertical and horizontal magnetic flux densities as shown in FIG. 2 and as disclosed in the Japanese Patent Laid-open No. 2003-15422.

Meanwhile, to insure a long lifespan for the developer, it is preferable to reduce stress on the developer-regulating position, which again depends on the low magnetic attraction force.

Magnetic poles adjacent to the developer-regulating position are the main cause of the deterioration of the developer. The magnetism may be stronger when more magnetic poles precede the developer-regulating position. However, this shortens the lifespan of the developer. This is because the magnetic attraction force increases at the positions preceding the developer-regulating position.

Thus, a low magnetic attraction force at a position preceding the developer-regulating position is an essential condition for low stress on and a longer lifespan for the developer. If a peak value of the magnetic attraction force precedes the developer-regulating position, the developer past the developer-regulating position tends to return to the position of the peak magnetic attraction force and therefore, transfer of the developer becomes unstable.

To summarize, it is an effective condition for stabilizing the transfer amount of the developer that the peak magnetic attraction force does not exist at position preceding the developer-regulating position.

SUMMARY OF THE INVENTION

An aspect of the present invention is to solve at least the above problems and/or disadvantages and to provide at least the advantages described below. Accordingly, an aspect of the present invention is to provide a developing unit capable of preventing deterioration of a developer by decreasing stress through inducing a magnetism from a slope of a magnetic curve of each magnetic pole formed in a magnetic field generating means and assuring stable transfer of the developer in a developer-regulating position based on the magnetic attraction force, and an image forming apparatus having the same.

Another aspect of the present invention is to provide a method for regulating an amount of the developer transferred from the developing unit of the image forming apparatus to a photoconductive drum, and the developing unit applying the method.

In order to achieve the above-described aspects of the present invention, there is provided a developing unit for an image forming apparatus, comprising a developer receptacle for containing a developer composed by non-magnetic toner and magnetic carrier; a developer transferring means for supplying the developer in the developer receptacle to an electrostatic latent image formed on a photoconductive medium; a magnetic field generating means mounted to the developer transferring means; and a regulating means for restricting an amount of the developer transferred to the photoconductive medium by the developer transferring means. A position for the regulating means to control the developer transferred to the photoconductive medium satisfies the equations below:

$$Fr=Br^2+400\times(dBr/d\alpha)^2,$$

$$Gr=dFr/d\alpha,$$

$$X\leqq Gr\leqq Y$$

where, Br in units of mT denotes the magnetism in a normal direction with respect to a surface of the developer transferring means, $\alpha$ denotes an angle of magnetic poles of a magnetic field generating means (preferably, the N1 pole), Fr denotes a magnetic attraction force (in graphic representation), ($dBr/d\alpha$) denotes a slope of a Br curve (differential), ($dFr/d\alpha$) denotes a slope of an Fr curve (differential) and Gr is the range for the developer-regulating position, wherein Gr has a lower limit X and an upper limit Y.

In order to achieve another aspect of the present invention, there is provided a method for controlling a developer in an image forming apparatus, wherein a position for the regulating blade to control the developer transferred to the photoconductive drum satisfies the equations below:

$$Fr=Br^2+400\times(dBr/d\alpha)^2,$$

$$Gr=dFr/d\alpha,$$

$$X\leqq Gr\leqq Y$$

where, Br in units of mT denotes a magnetism in a normal direction with respect to a surface of the developer transferring means, $\alpha$ denotes an angle of magnetic poles of a magnetic field generating means (N1 pole), Fr denotes a magnetic attraction force (in graphic representation), ($dBr/d\alpha$) denotes a slope of a Br curve (differential), ($dFr/d\alpha$) denotes a slope of an Fr curve (differential) and Gr is the range for the developer-regulating position, wherein Gr has a lower limit X and an upper limit Y.

According to an aspect of the present invention, the magnetic attraction force Fr of a developer-regulating pole of the magnetic field generating means does not have a peak value preceding the magnetic field generating means but gradually increases past the magnetic filed generating means. Additionally, the developer-regulating pole and a receiving pole of the developer regulating means have the same polarity.

BRIEF DESCRIPTION OF THE DRAWINGS

The above aspect and other features of the present invention will become more apparent by describing in detail exemplary embodiments thereof with reference to the attached drawing figures, wherein.

It should be understood that like reference numbers refer to like features, structures, and elements.

DETAILED DESCRIPTION OF EXEMPLARY EMBODIMENTS

Hereinafter, an exemplary embodiment of the present invention will be described in detail with reference to the accompanying drawing figures.

The matters defined in the description such as a detailed construction and elements are provided to assist in the comprehensive understanding of the invention. Thus, it is apparent that various modifications and changes to the embodiments of the present invention described herein can be made without departing for the scope and spirit of the invention. Also, well-known functions or constructions are not described in detail for the sake of clarity and conciseness.

Figure 1:
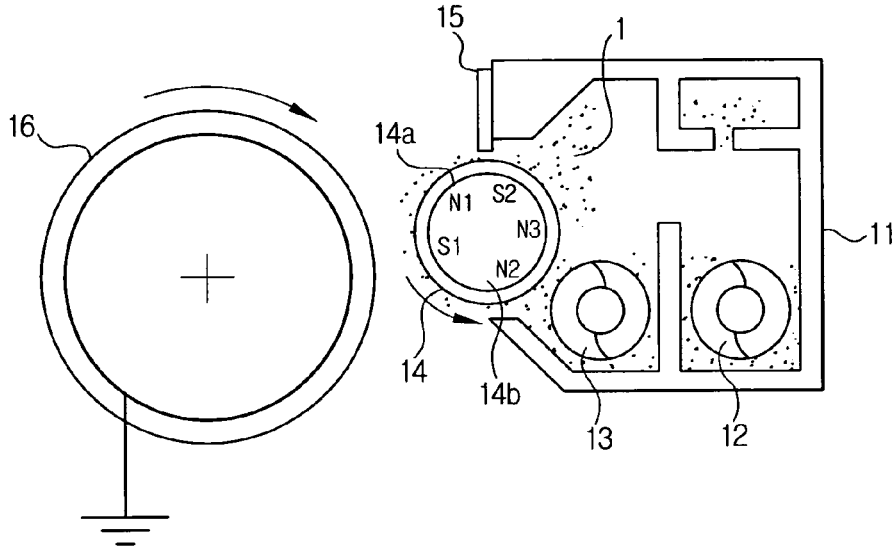
FIG. 1 (PRIOR ART)
FIG. 1 is a schematic view of a conventional developing unit of an image forming apparatus.
Figure 2:
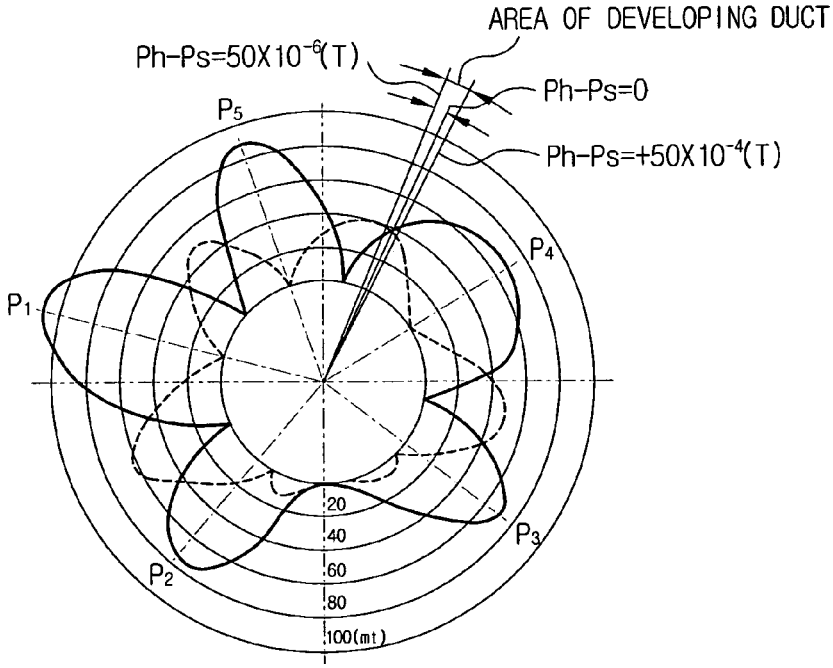
FIG. 2 (PRIOR ART)
FIG. 2 is a wave-form chart of the magnetic flux density of a developing roller for explaining a method for regulating a developer in the conventional developing unit of the image forming apparatus.
Figure 3:
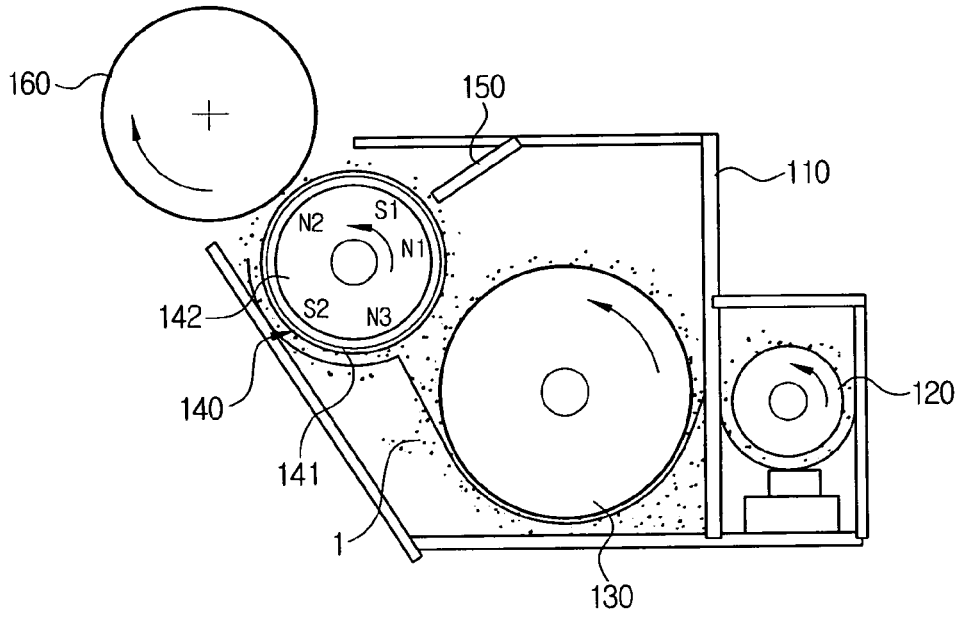
FIG. 3 is a schematic view of an exemplary developing unit of an image forming apparatus according to an embodiment of the present invention.
Figure 4:
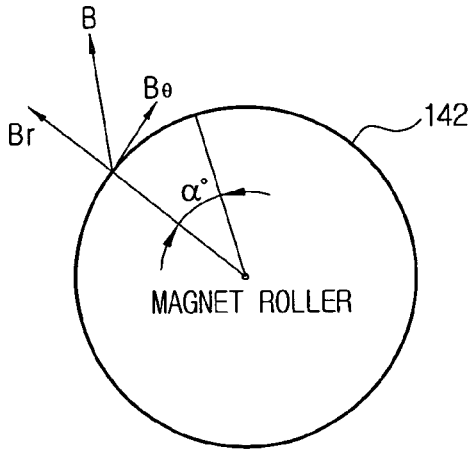
FIG. 4 is a schematic view for showing the relationships of magnetic attraction force between a circumferential direction and a normal direction of a developing roller of the developing unit of the image forming apparatus according to an embodiment of the present invention.

Referring to FIGS. 3 and 4, a developing unit according to an embodiment of the present invention comprises a developing sleeve 141 rotatably mounted in a developer receptacle 110 containing a developer 1 therein, a magnet roller 142 fixed in the developing sleeve 141, developer-supply rollers 120 and 130 such as agitating screws for transferring the developer 1 onto a surface of the developing sleeve 141, and a regulating blade 150 for restricting the thickness of the developer supplied to the surface of the developing sleeve 141 to a thin layer. A photoconductive drum 160 serves as an image carrier, and a developing roller 140 comprises the developing sleeve 141 and the magnet roller 142.

In the above-structured developing unit, the position of the regulating blade 150 to control the developer 1 transferred to the photoconductive drum 160 satisfies the equations below.

$$Fr=Br^2+400\times(dBr/d\alpha)^2,\ Gr=dFr/d\alpha,\ X\leqq Gr\leqq Y$$

wherein, Br in mT denotes a magnetism in a normal direction with respect to a surface of the magnet roller 142, $\alpha$ denotes an angle of magnetic poles of a magnetic field generating means (N1 pole), Fr denotes a magnetic attraction force (in graphic representation), ($dBr/d\alpha$) denotes a slope of a Br curve (differential), ($dFr/d\alpha$) denotes a slope of an Fr curve (differential), and Gr is the range of the developer-regulating position, wherein Gr has a lower limit X and an upper limit Y. In this exemplary embodiment, X is equal to 10 and Y is equal to 50.

According to the above-structured developing unit, the developer 1 is transferred in the order of N1→S1→N2→S2→N3 poles as the developing sleeve 141 rotates. During the transfer of the developer 1, the developer 1 supplied to the N1 pole is restricted to a predetermined thickness by the regulating blade 150, thereby being formed as a thin layer on the developing sleeve 141. When the developer 1 in the thin layer form is transferred to the S1 pole, the developer 1 drawn by the magnetism develops an electrostatic latent image formed on the photoconductive drum 160. The developer 1 on the developing sleeve 141 is recovered into the developer receptacle 110 by the repulsive magnetic fields of the N2 and N3 poles.

Hereinbelow, the operation of the magnetic roller 142 for regulating the developer 1 at the N1 pole will be explained with reference to FIG. 5.

Figure 5:
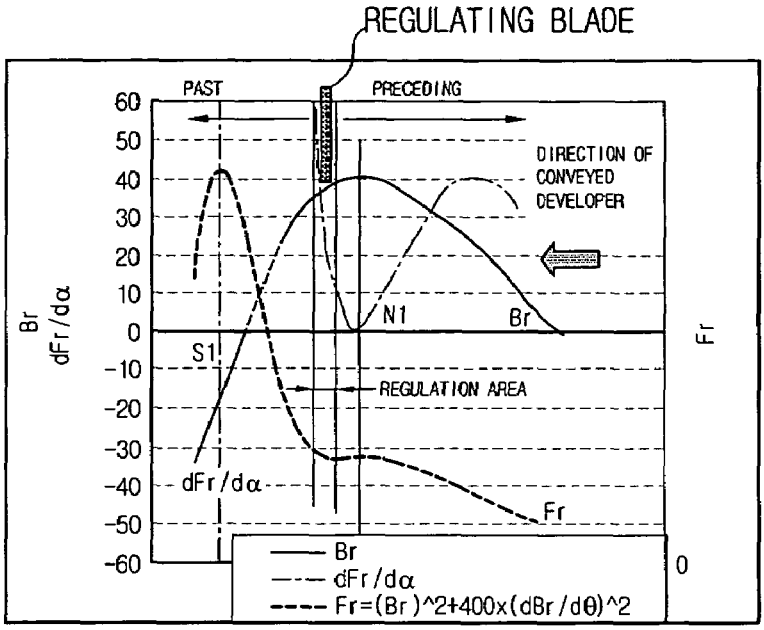
FIGS. 5 and 6 are graphs comparing the magnetism in the normal direction of the developing roller with the magnetic attraction force in graphic representation of a developing unit according to an embodiment of the present invention and the conventional developing unit, respectively.

As shown in a curve pattern of a graph in FIG. 5, the plot representing the magnetic attraction (Fr) of the N1 regulation pole gradually rises as going toward a lower stream, that is, toward the S1 pole. The curve then becomes smooth and suddenly rises.

Figure 6:
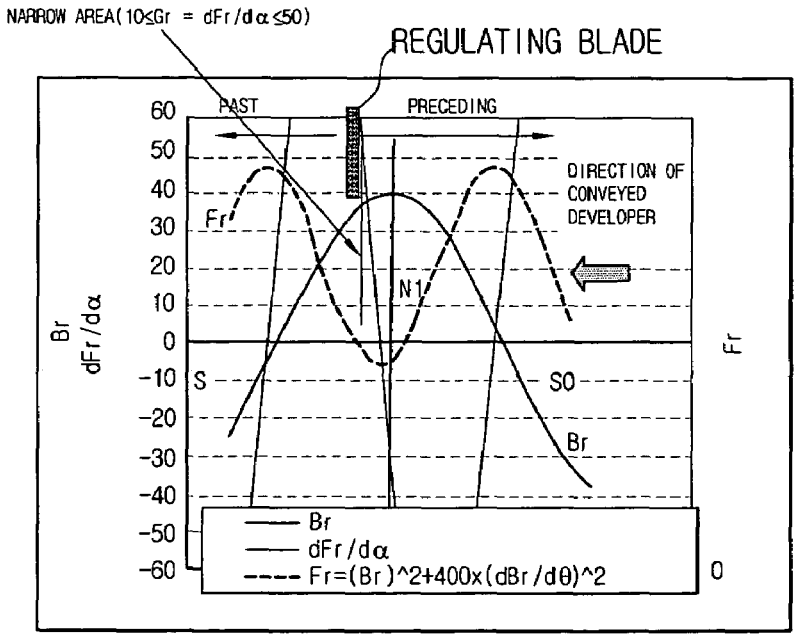
FIG. 6 (PRIOR ART)

On the contrary, the plot representing the magnetic attraction (Fr) of the N1 regulation pole in the conventional developing unit as shown in FIG. 6 shows a great difference from the graph in FIG. 5 according to an embodiment of the present invention, in a manner that the slant greatly fluctuates as going toward the lower stream, that is, toward the S1 pole. Furthermore, the regulating blade 150 is disposed where the curve slant is steep, and this is the difference of the conventional art from embodiments of the present invention.

To summarize, the developing unit according to an embodiment of the present invention has characteristics in which the regulating blade 150 is disposed so as to control the developer 1 at a position where the curved line of the magnetism (Fr) becomes more stable.

The characteristics and feature of the above structure are as follows.

If the regulation of the developer is performed at a position where the magnetism rapidly changes, transferability varies according to portions of the developing sleeve 141. Therefore, the structure of the magnetic roller 142 may preferably be formed to have the magnetic attraction force gradually increasing toward the regulating blade 150, increasing particularly slow around the developer-regulating position, which is the vicinity of peak magnetism of the regulating poles N1 through S2.

The developer transferability is determined by magnetic attraction force×friction coefficient between the developer and the developing sleeve surface. Since the magnetic attraction force largely influences the transferability, it is preferable that the developer regulation is performed where the magnetic attraction force does not radically change.

Therefore, in an image forming apparatus according to the above structure, the peak value of the magnetic attraction force does not exist at the upper stream of the regulating blade 150, and accordingly, the stress is reduced.

In addition, since the developer regulation is performed where the magnetic attraction force Fr is stable, the transferred amount of the developer 1 at the magnetic roller 142 varies to a minor degree, and the developer 1 can be prevented from being returned to the position where the magnetic attraction force has the peak value. Accordingly, the transferred amount of the developer 1 can be stabilized.

Figure 7:
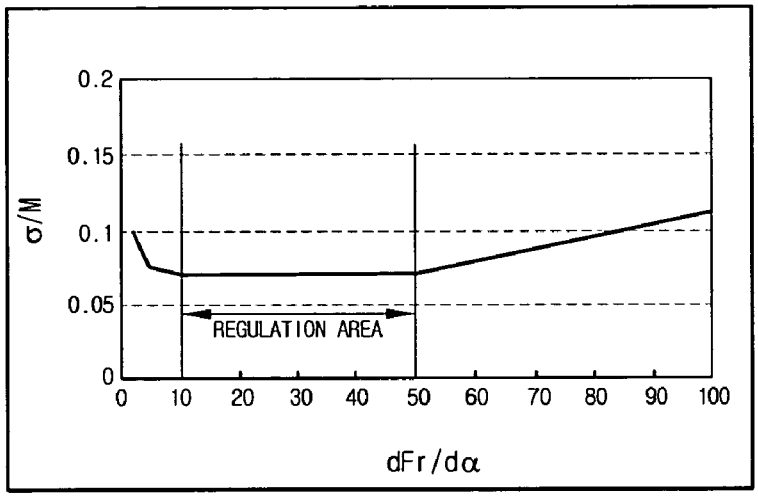
FIGS. 7 and 8 are graphs for comparing changes of the transferred amount of developer of the developing unit according to an embodiment of the present invention and the conventional developing unit, respectively.
Figure 8:
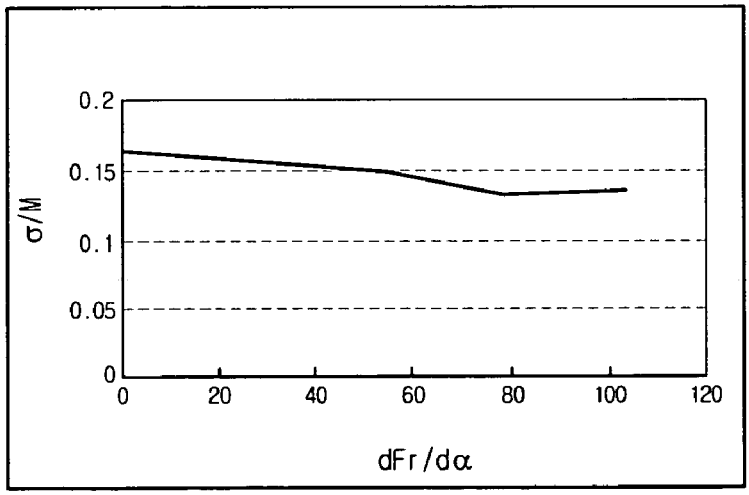
FIG. 8 (PRIOR ART)

FIGS. 7 and 8 are graphs for comparing the effect of developer regulation in the conventional developing unit and the developing unit according to an embodiment of the present invention, respectively. The graphs illustrate changes of the transferred amount of developer 1 when the developer-regulation position is moved from the upper stream of the peak magnetism of the N1 pole to the lower stream of the S1 pole.

Conditions for the experiment of FIGS. 7 and 8 are as follows. ① carrier: 35 μm silicon+acryl coat, Ferrite carrier, specific gravity 5.5 (g/cm3), ② toner: 8 μm, ③ toner density (Tc): 7 wt %, ④ apparent specific gravity of developer: 2.01 g/cm3, ⑤ magnetism of N1 pole: 40 mT, ⑥ magnetism of S1 pole: 60 mT, ⑦ regulation gap: 0.45 mm.

In the developing unit according to an embodiment of the present invention, as shown in FIG. 5, the regulation pole N1 also acts as a receiving pole. In the conventional developing unit of FIG. 6, the receiving pole S0 is disposed preceding the regulation pole N1.

The transfer amount of the developer 1 is measured at five locations on the developing sleeve 141, and values obtained by dividing a standard deviation $\sigma$ of the measured values by an average M ($g/m^2$), are compared, respectively, in the conventional developing unit and the developing unit according to an embodiment of the present invention.

As a result of the comparison of FIGS. 7 and 8, the patterns of the magnetic attraction force Fr turned out in the conventional developing unit to be notably different from those in the developing unit according to an embodiment of the present invention.

Especially, as shown in FIG. 7, the differences in the transferred amount in the developing unit according to an embodiment of the present invention, radically increases where the magnetic attraction force Fr is not less than 50 and not more than 10. This is because the value of $\sigma/M$ suddenly increases where the magnetic attraction force is more than 50 and suddenly decreases where the magnetic attraction force is less than 10.

Accordingly, the range of the developer-regulating position is determined to be '$X\leqq Gr\leqq Y$', wherein X is equal to 10 and Y is equal to 50.

As can be appreciated from the above description of a few exemplary embodiments, in the developing unit according to embodiments of the present invention, deterioration of the developer 1, due to lower stress, can be prevented from deteriorating by locating the regulating blade 150 to where the magnetic attraction force minimally changes, thereby guaranteeing stable transfer of the developer 1. Also, in addition to the elongated lifespan of the developer 1, improved image quality can be provided.

While the invention has been shown and described with reference to certain embodiments thereof, it will be understood by those skilled in the art that various changes in form and details may be made therein without departing from the spirit and scope of the invention as defined by the appended claims.

What is claimed is:

1. A developing unit for an image forming apparatus, comprising:

a developer receptacle for containing a developer comprising a non-magnetic toner and a magnetic carrier;

a developer transferring means for supplying the developer of the developer receptacle to an electrostatic latent image formed on a photoconductive medium;

a magnetic field generating means mounted to the developer transferring means and comprising magnetic poles; and a regulating means for restricting an amount of the developer transferred to the photoconductive medium by the developer transferring means, wherein a range of positions for the regulating means to control the developer transferred to the photoconductive medium satisfies the equations below:

$$Fr=Br^2+400\times(dBr/d\alpha)^2,$$

$$Gr=dFr/d\alpha,$$

$$X\leqq Gr\leqq Y$$

where, Br denotes a magnetism in a normal direction with respect to a surface of the developer transferring means, α denotes an angle of magnetic poles of a magnetic field generating means (N1 pole), Fr denotes a magnetic attraction force (in graphic representation), (dBr/dα) denotes a slope of a Br curve (differential), (dFr/dα) denotes a slope of an Fr curve (differential), and Gr is the range of the developer-regulating position.

2. The developing unit of claim 1, wherein the magnetic attraction force Fr of a developer-regulating pole of the magnetic field generating means does not have a peak value preceding the magnetic field generating means, but gradually increases at a location past the magnetic filed generating means.

3. The developing unit of claim 1, wherein the developer-regulating magnetic pole and a receiving magnetic pole of the developer regulating means have the same polarity.

4. The developing unit of claim 1, wherein Gr has a lower limit X equal to 10 and an upper limit Y equal to 50.

5. An image forming apparatus comprising a developing unit for developing by a developer and visualizing an electrostatic latent image formed on a photoconductive medium, wherein the developing unit comprises:

a developer receptacle containing a developer comprising a non-magnetic toner and a magnetic carrier;

a developer transferring means for supplying the developer of the developer receptacle to an electrostatic latent image formed on a photoconductive medium;

a magnetic field generating means mounted to the developer transferring means and comprising magnetic poles; and a regulating means for restricting an amount of the developer transferred to the photoconductive medium by the developer transferring means, and wherein a position for the regulating means to control the developer transferred to the photoconductive medium satisfies the equations below:

$$Fr=Br^2+400\times(dBr/d\alpha)^2,$$

$$Gr=dFr/d\alpha,$$

$$X\leqq Gr\leqq Y$$

where, Br denotes a magnetism in a normal direction with respect to a surface of the developer transferring means, α denotes an angle of magnetic poles of a magnetic field generating means (N1 pole), Fr denotes a magnetic attraction force (in graphic representation), (dBr/D α) denotes a slope of a Br curve (differential), (dFr/d α) denotes a slope of an Fr curve (differential), and Gr is the range of the developer-regulating position.

6. The image forming apparatus of claim 5, wherein the magnetic attraction force Fr of a developer-regulating magnetic pole of the magnetic field generating means does not have a peak value at a position preceding the magnetic field generating means but gradually increases at a location past the magnetic filed generating means.

7. The image forming apparatus of claim 5, wherein the developer-regulating magnetic pole and a receiving magnetic pole of the developer regulating means have the same polarity.

8. The image forming apparatus of claim 5, wherein Gr has a lower limit X equal to 10 and an upper limit Y equal to 50.

9. A method for regulating a developer in an image forming apparatus, comprising the step:

determining the position where a regulating means that controls a developer transferred to a photoconductive medium should be located by satisfying the equations below:

$$Fr=Br^2+400\times(dBr/d\alpha)^2,$$

$$Gr=dFr/d\alpha,$$

$$X\leqq Gr\leqq Y$$

where, Br denotes a magnetism in a normal direction with respect to a surface of the developer transferring means, α denotes an angle of magnetic poles of a magnetic field generating means (N1 pole), Fr denotes a magnetic attraction force (in graphic representation), (dBr/dα) denotes a slope of a Br curve (differential), (dFr/dα) denotes a slope of an Fr curve (differential), and Gr is the range of the developer-regulating position.

10. The method of claim 9, wherein the magnetic attraction force Fr of a developer-regulating pole of the magnetic field generating means does not have a peak value at an upper stream of the magnetic field generating means but gradually increases toward a lower stream of the magnetic filed generating means.

11. The method of claim 9, wherein the developer-regulating pole and a receiving pole of the developer regulating means have the same polarity.

12. The method of claim 9, wherein Gr has a lower limit X equal to 10 and an upper limit Y equal to 50.

* * * * *